US008663807B2

(12) United States Patent
Dolan

(10) Patent No.: US 8,663,807 B2
(45) **Date of Patent: *Mar. 4, 2014**

(54) ARTICLE OF MANUFACTURE AND PROCESS FOR ANODICALLY COATING ALUMINUM AND/OR TITANIUM WITH CERAMIC OXIDES

(75) Inventor: Shawn E. Dolan, Sterling Heights, MI (US)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/510,665

(22) Filed: Jul. 28, 2009

(65) Prior Publication Data

US 2010/0000870 A1 Jan. 7, 2010

Related U.S. Application Data

(60) Division of application No. 10/972,594, filed on Oct. 25, 2004, now Pat. No. 7,578,921, which is a continuation-in-part of application No. 10/162,965, filed on Jun. 5, 2002, now Pat. No. 6,916,414, which is a continuation-in-part of application No. 10/033,554, filed on Oct. 19, 2001, now abandoned, which is a continuation-in-part of application No. 09/968,023, filed on Oct. 2, 2001, now abandoned.

(51) Int. Cl.
*B32B 15/04* (2006.01)
*C25D 9/06* (2006.01)

(52) U.S. Cl.
USPC ..... 428/469; 428/472; 428/472.2; 428/472.1; 428/632; 428/650; 428/633; 428/651; 428/660; 428/421; 428/422; 428/447; 428/934; 205/50

(58) Field of Classification Search
None
See application file for complete search history.

(56) References Cited

U.S. PATENT DOCUMENTS

| | | | | |
|---|---|---|---|---|
| 2,081,121 | A | | 5/1937 | Stareck |
| 2,231,373 | A | | 2/1941 | Schenk |
| 2,275,223 | A | | 3/1942 | Hardoen |
| 2,305,669 | A | | 12/1942 | Budiloff et al. |
| 2,573,229 | A | | 10/1951 | Stern |
| 2,858,285 | A | | 10/1958 | Johnson |
| 2,880,148 | A | | 3/1959 | Evangelides |
| 2,901,409 | A | | 8/1959 | De Long |
| 2,926,125 | A | | 2/1960 | Currah et al. |
| 3,343,930 | A | | 9/1967 | Borzillo et al. |
| 3,345,276 | A | | 10/1967 | Munroe |
| 3,524,799 | A | | 8/1970 | Dale |
| 3,620,940 | A | | 11/1971 | Wick |
| 3,681,180 | A | | 8/1972 | Kent |
| 3,729,391 | A | | 4/1973 | Houghton et al. |
| 3,778,315 | A | | 12/1973 | Booker et al. |
| 3,824,159 | A | | 7/1974 | Wehrmann |
| 3,864,224 | A | | 2/1975 | Cotton et al. |
| 3,865,560 | A | | 2/1975 | Sabetay |
| 3,945,899 | A | | 3/1976 | Nikaido et al. |
| 3,950,240 | A | * | 4/1976 | Cookfair et al. ..... 204/290.08 |
| 3,956,080 | A | | 5/1976 | Hradcovsky et al. |
| 3,960,676 | A | | 6/1976 | Miyosawa et al. |
| 3,996,115 | A | | 12/1976 | Kessler |
| 4,082,626 | A | | 4/1978 | Hradcovsky |
| 4,094,750 | A | | 6/1978 | Mackey |
| RE29,739 | E | | 8/1978 | Kessler |
| 4,110,147 | A | | 8/1978 | Grunwald et al. |
| 4,113,598 | A | | 9/1978 | Jozwiak, Jr. et al. |
| 4,145,263 | A | | 3/1979 | Tsutsui et al. |
| 4,166,777 | A | | 9/1979 | Casson, Jr. et al. |
| 4,184,926 | A | | 1/1980 | Kozak |
| 4,188,270 | A | | 2/1980 | Kataoka |
| 4,200,475 | A | | 4/1980 | Kasahara et al. |
| 4,227,976 | A | | 10/1980 | Menke |
| 4,298,661 | A | | 11/1981 | Ikeno et al. |
| 4,370,538 | A | | 1/1983 | Browning |
| 4,383,897 | A | | 5/1983 | Gillich et al. |
| 4,399,021 | A | | 8/1983 | Gillich et al. |
| 4,401,489 | A | | 8/1983 | Arai et al. |
| 4,439,287 | A | | 3/1984 | Birkle et al. |
| 4,448,647 | A | | 5/1984 | Gillich et al. |
| 4,452,674 | A | | 6/1984 | Gillich et al. |
| 4,455,201 | A | | 6/1984 | Birkle et al. |
| 4,456,663 | A | | 6/1984 | Leonard |
| 4,473,110 | A | | 9/1984 | Zawierucha |
| 4,511,633 | A | | 4/1985 | Bruno et al. |
| 4,551,211 | A | | 11/1985 | Kobayashi et al. |

(Continued)

FOREIGN PATENT DOCUMENTS

| | | |
|---|---|---|
| CA | 2474367 A1 | 1/2006 |
| CA | 2479032 A1 | 3/2006 |

(Continued)

OTHER PUBLICATIONS

Zozulin, Alex J.; "A Chromate-Free Anodize Process for Magnesium Alloys: A Coating With Superior Characteristics", pp. 47-63.
Zozejlin, et al; "Anodized Coatings for Magnesium Alloys", Metal Finishing, Mar. 1994, pp. 39-44.
IBM Technical Disclosure Bulletin, "Forming Protective Coatings on Magnesium Alloys", Dec. 1967, p. 862.
Barton, et al; "The Effect of Electrolyte on the Anodized Finish of a Magnesium Alloy": Plating & Surface Finishing, pp. 138-141.
Jakobson, et al; "Magnesium Anodizing", 85th American Electroplaters and Surface Finishers Socialy, pp. 541-549.

(Continued)

*Primary Examiner* — Vera Katz
(74) *Attorney, Agent, or Firm* — Mary K. Cameron

(57) ABSTRACT

An article of manufacture and a process for making the article by generating corrosion-, heat- and abrasion-resistant ceramic coatings comprising titanium and/or zirconium dioxide using direct and alternating current on anodes comprising aluminum and/or titanium. Optionally, the article is coated with additional layers, such as paint, after deposition of the ceramic coating.

39 Claims, 3 Drawing Sheets

(56) References Cited

U.S. PATENT DOCUMENTS

| | | | | |
|---|---|---|---|---|
| 4,578,156 | A | | 3/1986 | Plazter |
| 4,579,786 | A | | 4/1986 | Nakakouji et al. |
| 4,620,904 | A | | 11/1986 | Kozak |
| 4,659,440 | A | | 4/1987 | Hradcovsky |
| 4,668,347 | A | | 5/1987 | Habermann et al. |
| 4,705,731 | A | * | 11/1987 | Saitoh et al. ..... 430/57.6 |
| 4,744,872 | A | | 5/1988 | Kobayashi et al. |
| 4,775,600 | A | | 10/1988 | Adaniya et al. |
| 4,786,336 | A | | 11/1988 | Schoener et al. |
| 4,839,002 | A | | 6/1989 | Pernick et al. |
| 4,859,288 | A | | 8/1989 | Furneaux et al. |
| 4,869,789 | A | | 9/1989 | Kurze et al. |
| 4,869,936 | A | | 9/1989 | Moskowitz et al. |
| 4,882,014 | A | | 11/1989 | Coyle et al. |
| 4,976,830 | A | | 12/1990 | Schmeling et al. |
| 4,978,432 | A | | 12/1990 | Schmeling et al. |
| 5,032,129 | A | | 7/1991 | Kurze et al. |
| 5,087,645 | A | | 2/1992 | Kojima et al. |
| 5,100,486 | A | | 3/1992 | Krikorian et al. |
| 5,102,746 | A | | 4/1992 | Shindou et al. |
| 5,201,119 | A | | 4/1993 | Mizuno et al. |
| 5,221,576 | A | | 6/1993 | Bosc et al. |
| H1207 | H | | 7/1993 | Smith |
| 5,240,589 | A | | 8/1993 | Bartak et al. |
| 5,264,113 | A | | 11/1993 | Bartak et al. |
| 5,266,412 | A | | 11/1993 | Bartak et al. |
| 5,275,713 | A | | 1/1994 | Hradcovsky |
| 5,283,131 | A | | 2/1994 | Mori et al. |
| 5,302,414 | A | | 4/1994 | Alkhimov et al. |
| 5,314,334 | A | * | 5/1994 | Panzera et al. ..... 433/206 |
| 5,356,490 | A | * | 10/1994 | Dolan et al. ..... 148/247 |
| 5,385,662 | A | | 1/1995 | Kurze et al. |
| 5,441,580 | A | | 8/1995 | Tomlinson |
| 5,451,271 | A | | 9/1995 | Yoshida et al. |
| 5,470,664 | A | | 11/1995 | Bartak et al. |
| 5,478,237 | A | | 12/1995 | Ishizawa |
| 5,583,704 | A | | 12/1996 | Fujii |
| 5,700,366 | A | | 12/1997 | Steblianko et al. |
| 5,759,251 | A | | 6/1998 | Nakamura et al. |
| 5,775,892 | A | | 7/1998 | Miyasaka et al. |
| 5,792,335 | A | | 8/1998 | Barton |
| 5,811,194 | A | | 9/1998 | Kurze et al. |
| 5,837,117 | A | | 11/1998 | Allegret |
| 5,945,035 | A | * | 8/1999 | Vogt et al. ..... 252/520.1 |
| 5,958,604 | A | | 9/1999 | Riabkov et al. |
| 5,981,084 | A | | 11/1999 | Riabkov et al. |
| 6,030,526 | A | | 2/2000 | Porter |
| 6,059,897 | A | | 5/2000 | Koerner et al. |
| 6,068,890 | A | * | 5/2000 | Kaumle et al. ..... 427/534 |
| 6,082,444 | A | | 7/2000 | Harada et al. |
| 6,090,490 | A | | 7/2000 | Mokerji |
| 6,127,052 | A | | 10/2000 | Tomari |
| 6,153,080 | A | | 11/2000 | Heimann et al. |
| 6,159,618 | A | | 12/2000 | Danroc et al. |
| 6,165,630 | A | | 12/2000 | Gehlhaar et al. |
| 6,180,548 | B1 | | 1/2001 | Taoda et al. |
| 6,197,178 | B1 | | 3/2001 | Patel et al. |
| 6,245,436 | B1 | | 6/2001 | Boyle |
| 6,280,598 | B1 | | 8/2001 | Barton et al. |
| 6,335,099 | B1 | | 1/2002 | Higuchi et al. |
| 6,372,115 | B1 | | 4/2002 | Miyasaka et al. |
| 6,595,341 | B1 | | 7/2003 | Venz |
| 6,599,618 | B1 | | 7/2003 | Simmon, Jr. |
| 6,797,147 | B2 | | 9/2004 | Dolan |
| 6,861,101 | B1 | | 3/2005 | Kowalsky et al. |
| 6,863,990 | B2 | | 3/2005 | Wu et al. |
| 6,869,703 | B1 | | 3/2005 | Spitsberg et al. |
| 6,875,529 | B1 | | 4/2005 | Spitsberg et al. |
| 6,896,970 | B2 | | 5/2005 | Mayzel |
| 6,916,414 | B2 | | 7/2005 | Dolan |
| 7,452,454 | B2 | | 11/2008 | Dolan |
| 7,569,132 | B2 | | 8/2009 | Dolan |
| 7,578,921 | B2 | | 8/2009 | Dolan |
| 7,820,300 | B2 | | 10/2010 | Dolan |
| 2001/0007714 | A1 | | 7/2001 | Gaboury et al. |
| 2003/0000847 | A1 | | 1/2003 | Ostrovsky |
| 2003/0070935 | A1 | | 4/2003 | Dolan |
| 2003/0075453 | A1 | | 4/2003 | Dolan |
| 2003/0118664 | A1 | | 6/2003 | Trogolo et al. |
| 2003/0150524 | A1 | | 8/2003 | Wichelhaus et al. |
| 2004/0081881 | A1 | * | 4/2004 | Vyas et al. ..... 429/44 |
| 2004/0099535 | A1 | | 5/2004 | Schweinsberg et al. |
| 2004/0129294 | A1 | | 7/2004 | Takamasa et al. |
| 2004/0202890 | A1 | * | 10/2004 | Kutilek et al. ..... 428/689 |
| 2004/0245496 | A1 | | 12/2004 | Taoda |
| 2005/0175798 | A1 | * | 8/2005 | Kurokawa et al. ..... 428/34.1 |
| 2006/0099397 | A1 | | 5/2006 | Thierauf et al. |
| 2007/0144914 | A1 | | 6/2007 | Schweinsberg et al. |
| 2008/0248214 | A1 | | 10/2008 | Nie et al. |
| 2009/0098373 | A1 | | 4/2009 | Dolan |
| 2009/0162563 | A1 | | 6/2009 | Schweinsberg et al. |
| 2009/0258242 | A1 | | 10/2009 | Dolan |
| 2010/0252241 | A1 | | 10/2010 | McDermott et al. |

FOREIGN PATENT DOCUMENTS

| | | | | |
|---|---|---|---|---|
| CA | 2585278 | A1 | | 5/2006 |
| CA | 2585283 | A | | 5/2006 |
| CA | 2556869 | A1 | | 2/2008 |
| CN | 1392284 | A | | 1/2003 |
| DE | 3516411 | | * | 11/1986 |
| DE | 289054 | A5 | | 4/1991 |
| DE | 289065 | A5 | | 4/1991 |
| DE | 4104847 | A1 | | 8/1992 |
| EP | 0259657 | A1 | | 3/1988 |
| EP | 0594374 | A1 | | 4/1994 |
| EP | 0823496 | A1 | | 2/1998 |
| EP | 0978576 | A1 | | 2/2000 |
| EP | 1002644 | A2 | | 5/2000 |
| EP | 0780494 | B1 | | 11/2002 |
| EP | 1407832 | A2 | | 4/2004 |
| FR | 2549092 | A1 | | 1/1985 |
| FR | 2657090 | A1 | | 7/1991 |
| GB | 294237 | A | | 9/1929 |
| GB | 493935 | A | | 10/1938 |
| GB | 1051665 | A | | 12/1966 |
| GB | 1319912 | A | | 6/1973 |
| GB | 2158842 | A | | 11/1985 |
| GB | 2343681 | A | | 5/2000 |
| JP | 5311133 | A | | 2/1978 |
| JP | 56152994 | A | | 11/1981 |
| JP | 57057888 | A | | 4/1982 |
| JP | 57060098 | A | | 4/1982 |
| JP | 58001093 | A | | 1/1983 |
| JP | 59016994 | A | | 1/1984 |
| JP | 63100194 | A | | 5/1988 |
| JP | 4308093 | A | | 10/1992 |
| JP | 5287587 | A | | 11/1993 |
| JP | 6173034 | A | | 6/1994 |
| JP | 11043799 | | * | 2/1996 |
| JP | 09503824 | T | | 4/1997 |
| JP | 9176894 | A | | 7/1997 |
| JP | 10018082 | A | | 1/1998 |
| JP | 63087716 | A | | 4/1998 |
| JP | 11043799 | A | | 2/1999 |
| JP | 11324879 | A | | 11/1999 |
| JP | 2000248398 | A | | 9/2000 |
| JP | 2000273656 | A | | 10/2000 |
| JP | 3132133 | B2 | | 2/2001 |
| JP | 2001201288 | A | | 7/2001 |
| JP | 2004052000 | A | | 2/2004 |
| JP | 2004190121 | A | | 7/2004 |
| RU | 2049162 | C1 | | 11/1995 |
| RU | 2112087 | C1 | | 5/1998 |
| RU | 2213166 | C2 | | 9/2003 |
| SU | 617493 | A1 | | 7/1978 |
| WO | WO 92/14868 | A1 | | 9/1992 |
| WO | WO 98/42892 | A1 | | 10/1998 |
| WO | WO 98/42895 | A1 | | 10/1998 |
| WO | WO 99/02759 | A1 | | 1/1999 |
| WO | WO 00/03069 | A1 | | 1/2000 |
| WO | WO 02/28838 | A2 | | 4/2002 |

(56) References Cited

FOREIGN PATENT DOCUMENTS

| | | | |
|---|---|---|---|
| WO | 03029528 | A1 | 4/2003 |
| WO | WO 03/029529 | A1 | 4/2003 |
| WO | WO 2006/047500 | A2 | 5/2006 |

OTHER PUBLICATIONS

Yerokhin, A.L., et al, "Plasma Electrolysis for Surface Engineering", Surface and Coatings Technology 122, 1999, pp. 73-93.

Galvanotechnik, "Plasmachemische Oxicfationsverfahren Teil 1: Historie und Verfahrensgrundlagen", (Apr. 2003), pp. 816-823.

Galvanotechnik, "Plasmachemische Oxidationsverfahren Teil 2: Apparative Voraussetzungen", (Jun. 2003), pp. 1374-1382.

Galvanotechnik, Plasmachemische Oxidationsverfahren Teil 3: Neue Schichtsysteme, aussergewoehnliche Substratmaterialien und deren gegenwaertige und Zukuenftige Anwendungsfelder, (Jul. 2003), pp. 1634-1645.

Sworn Declaration of Dr. Peter Kurze dated Jul. 5, 2000, submitted in connection with PCT Publication WO 96/28591 of Magnesium Technology Limited.

Zhou, Y. et al, "Electrochemical Deposition and Microstructure of Copper (I) Oxide Films", Scripta Materlals, vol. 38, No. 11 pp. 1731-1738 (1998).

Yoshimura et al, "Recent developments In soft, solution processing: one step fabrication of functional double oxide films by hydrothermal-electrochemical methods", Journal of Materials Chemistry, vol. 9, pp. 77-82 (1999).

International Search Report dated Mar. 28, 2007, PCT International Application PCT/US2005/038396.

Written Opinion dated Mar. 28, 2007, PCT International Application PCT/US2005/038396.

* cited by examiner

ARTICLE OF MANUFACTURE AND PROCESS FOR ANODICALLY COATING ALUMINUM AND/OR TITANIUM WITH CERAMIC OXIDES

This application is a divisional of application Ser. No. 10/972,594, filed Oct. 25, 2004, which is a continuation-in-part of application Ser. No. 10/162,965, filed Jun. 5, 2002, now U.S. Pat. No. 6,916,414, which is a continuation-in-part of application Ser. No. 10/033,554, filed Oct. 19, 2001, now abandoned, which is a continuation-in-part of application Ser. No. 09/968,023, filed Oct. 2, 2001, now abandoned, each of which are incorporated herein by reference.

FIELD OF THE INVENTION

This invention relates to anodically generating ceramic coatings, such as titanium and/or zirconium oxide coatings on workpieces having at least one metal surface of aluminum, titanium, aluminum alloy and/or titanium alloy, including aluminum, titanium, aluminum alloy and titanium alloy workpieces, and to articles of manufacture having such metal surfaces coated with ceramic oxide coatings.

BACKGROUND OF THE INVENTION

Aluminum and its alloys have found a variety of industrial applications. However, because of the reactivity of aluminum and its alloys, and their tendency toward corrosion and environmental degradation, it is necessary to provide the exposed surfaces of these metals with an adequate corrosion-resistant and protective coating. Further, such coatings should resist abrasion so that the coatings remain intact during use, where the metal article may be subjected to repeated contact with other surfaces, particulate matter and the like. Where the appearance of articles fabricated is considered important, the protective coating applied-thereto should additionally be uniform and decorative.

In order to provide an effective and permanent protective coating on aluminum and its alloys, such metals have been anodized in a variety of electrolyte solutions, such as sulfuric acid, oxalic acid and chromic acid, which produce an alumina coating on the substrate. While anodization of aluminum and its alloys is capable of forming a more effective coating than painting or enameling, the resulting coated metals have still not been entirely satisfactory for their intended uses. The coatings frequently lack one or more of the desired degree of flexibility, hardness, smoothness, durability, adherence, heat resistance, resistance to acid and alkali attack, corrosion resistance, and/or imperviousness required to meet the most demanding needs of industry.

It is known to anodize aluminum to deposit a coating of aluminum oxide, using a strongly acidic bath (pH<1). A drawback of this method is the nature of the anodized coating produced. The aluminum oxide coating is not as impervious to acid and alkali as other oxides, such as those of titanium and/or zirconium. So called, hard anodizing aluminum results in a harder coating of aluminum oxide, deposited by anodic coating at pH<1 and temperatures of less than 3° C., which generates an alpha phase alumina crystalline structure that still lacks sufficient resistance to corrosion and alkali attack.

Thus, there is still considerable need to develop alternative anodization processes for aluminum and its alloys which do not have any of the aforementioned shortcomings and yet still furnish corrosion-, heat- and abrasion-resistant protective coatings of high quality and pleasing appearance.

Aluminum and aluminum alloys are commonly used for automotive wheels since they are more corrosion resistant and lighter than traditional iron wheels. Despite the above-mentioned properties, bare aluminum substrates are not sufficiently resistant to corrosion; an aluminum oxide film tends to be formed on the surface and surface mars may readily develop into filiform corrosion. Conversion coating is a well-known method of providing aluminum and its alloys (along with many other metals) with a corrosion resistant coating layer. Traditional conversion coatings for aluminum wheels, namely chromate, are often environmentally objectionable, so that their use should be minimized for at least that reason. Non-chromate conversion coatings are relatively well known. For instance, conversion coating compositions and methods that do not require the use of chromium or phosphorus are taught in U.S. Pat. Nos. 5,356,490 and 5,281,282, both of which are assigned to the same assignee as this application.

Original equipment manufacturers for automobiles have specific corrosion resistance tests for their aluminum alloy wheels. While certain conversion coatings have been suitable for imparting corrosion resistance to many types of surfaces, they have not been deemed acceptable for imparting corrosion resistance to other surfaces requiring a relatively high level of corrosion resistance, such as aluminum alloy wheels.

Accordingly, is desirable to provide a coating, a composition, and a process therefor that are at least as reliable for the surfaces requiring a relatively high level of corrosion resistance as that provided by conventional chromate conversion coating. Still other concurrent and/or alternative advantages will be apparent from the description below.

SUMMARY OF THE INVENTION

Applicant has discovered that articles of aluminum, titanium, aluminum alloy or titanium alloy may be rapidly anodized to form uniform, protective oxide coatings that are highly resistant to corrosion and abrasion using anodizing solutions containing complex fluorides and/or complex oxyfluorides, in the presence of phosphorus containing acids and/or salts. The use of the term "solution" herein is not meant to imply that every component present is necessarily fully dissolved and/or dispersed. The anodizing solution is aqueous and contains one or more water-soluble and/or water-dispersible anionic species containing a metal, metalloid, and/or non-metal element. In preferred embodiments of the invention, the anodizing solution comprises one or more components selected from the group consisting of the following:

a) water-soluble and/or water-dispersible phosphorus acids and/or salts, preferably oxysalts, wherein the phosphorus concentration in the anodizing solution is at least 0.01M, and in a preferred embodiment not more than 0.25M;
b) water-soluble and/or water-dispersible complex fluorides of elements selected from the group consisting of Ti, Zr, Hf, Sn, Al, Ge and B;
c) water-soluble and/or water-dispersible zirconium oxysalts;
d) water-soluble and/or water-dispersible vanadium oxysalts;
e) water-soluble and/or water-dispersible titanium oxysalts;
f) water-soluble and/or water-dispersible alkali metal fluorides;
g) water-soluble and/or water-dispersible niobium salts;
h) water-soluble and/or water-dispersible molybdenum salts;
i) water-soluble and/or water-dispersible manganese salts;
j) water-soluble and/or water-dispersible tungsten salts; and
k) water-soluble and/or water-dispersible alkali metal hydroxides.

In one embodiment of the invention, niobium, molybdenum, manganese, and/or tungsten salts are co-deposited in a ceramic oxide film of zirconium and/or titanium.

The method of the invention comprises providing a cathode in contact with the anodizing solution, placing the article as an anode in the anodizing solution, and passing a current through the anodizing solution at a voltage and for a time effective to form the protective coating on the surface of the article. Direct current, pulsed direct current or alternating current may be used. Pulsed direct current or alternating current is preferred. When using pulsed current, the average voltage is preferably not more than 250 volts, more preferably, not more than 200 volts, or, most preferably, not more than 175 volts, depending on the composition of the anodizing solution selected. The peak voltage, when pulsed current is being used, is preferably not more than 600, preferably 500, most preferably 400 volts. In one embodiment, the peak voltage for pulsed current is not more than, in increasing order of preference 600, 575, 550, 525, 500 volts and independently not less than 300, 310, 320, 330, 340, 350, 360, 370, 380, 390, 400 volts. When alternating current is being used, the voltage may range from 200 to 600 volts. In another alternating current embodiment, the voltage is, in increasing order of preference 600, 575, 550, 525, 500 volts and independently not less than 300, 310, 320, 330, 340, 350, 360, 370, 380, 390, 400 volts. In the presence of phosphorus containing components, non-pulsed direct current, also known as straight direct current, may be used at voltages from 200 to 600 volts. The non-pulsed direct current desirably has a voltage of, in increasing order of preference 600, 575, 550, 525, 500 volts and independently not less than 300, 310, 320, 330, 340, 350, 360, 370, 380, 390, 400 volts.

It is an object of the invention to provide a method of forming a protective coating on a surface of an aluminum, aluminum alloy, titanium or titanium alloy article, the method comprising providing an anodizing solution comprised of water, a phosphorus containing acid and/or salt, and one or more additional components selected from the group consisting of: water-soluble complex fluorides, water-soluble complex oxyfluorides, water-dispersible complex fluorides, and water-dispersible complex oxyfluorides of elements selected from the group consisting of Ti, Zr, Hf, Sn, Al, Ge and B and mixtures thereof; providing a cathode in contact with the anodizing solution; placing an aluminum, aluminum alloy, titanium or titanium alloy article as an anode in the anodizing solution; and passing a current between the anode and cathode through the anodizing solution for a time effective to form a protective oxide coating on at least one surface of the article. It is a further object to provide a method wherein the article comprises predominantly titanium or aluminum. It is a further object to provide a method wherein the protective coating comprises predominantly oxides of Ti, Zr, Hf, Sn, Ge and/or B. It is a further object to provide a method wherein the article comprises predominantly aluminum and the protective coating is predominantly titanium dioxide.

It is a further object to provide a method wherein the current is direct current having an average voltage of not more than 200 volts. In a preferred embodiment, the protective coating is predominantly comprised of titanium dioxide. The protective coating is preferably formed at a rate of at least 1 micron thickness per minute; the current is preferably direct current or alternating current. In a preferred embodiment, the anodizing solution comprises water, a phosphorus containing acid and water-soluble and/or water-dispersible complex fluorides of Ti and/or Zr. Preferably the pH of the anodizing solution is 1-6.

Preferably, the phosphorus containing acid and/or salt comprises one or more of a phosphoric acid, a phosphoric acid salt, a phosphorous acid and a phosphorous acid salt. It is a further object of the invention to provide a process wherein the phosphorus containing acid and/or salt is present in a concentration, measured as P, of 0.01 to 0.25 M.

In a preferred embodiment, the anodizing solution is prepared using a complex fluoride selected from the group consisting of $H_2TiF_6$, $H_2ZrF_6$, $H_2HfF_6$, $H_2GeF_6$, $H_2SnF_6$, $H_3AlF_6$, $HBF_4$ and salts and mixtures thereof and optionally comprises HF or a salt thereof.

It is further object of the invention to provide a method of forming a protective coating on a surface of a metallic article comprised predominantly of aluminum or titanium, the method comprising: providing an anodizing solution comprised of water, a phosphorus containing oxy acid and/or salt, and a water-soluble complex fluoride and/or oxyfluoride of an element selected from the group consisting of Ti, Zr, and combinations thereof; providing a cathode in contact with the anodizing solution; placing a metallic article comprised predominantly of aluminum or titanium as an anode in the anodizing solution; and passing a direct current or an alternating current between the anode and the cathode for a time effective to form a protective coating comprising oxides of Ti and/or Zr on at least one surface of the metallic article.

It is a further object to provide a method wherein the anodizing solution is prepared using a complex fluoride comprising an anion comprising at least 2, preferably 4 fluorine atoms and at least one atom selected from the group consisting of Ti, Zr, and combinations thereof. It is a yet further object to provide a method wherein the anodizing solution is prepared using a complex fluoride selected from the group consisting of $H_2TiF_6$, $H_2ZrF_6$, and salts and mixtures thereof. Preferably, the complex fluoride is introduced into the anodizing solution at a concentration of at least 0.01M. The direct current preferably has an average voltage of not more than 250 volts. It is a further object to provide a method wherein the anodizing solution is additionally comprised of a chelating agent. In a preferred embodiment, the anodizing solution is comprised of at least one complex oxyfluoride prepared by combining at least one complex fluoride of at least one element selected from the group consisting of Ti and Zr and at least one compound which is an oxide, hydroxide, carbonate or alkoxide of at least one element selected from the group consisting of Ti, Zr, Hf, Sn, B, Al and Ge.

It is a yet further object of the invention to provide a method of forming a protective coating on an article having at least one metallic surface comprised of titanium, titanium alloy, aluminum or aluminum alloy, the method comprising providing an anodizing solution, the anodizing solution having been prepared by dissolving a water-soluble complex fluoride and/or oxyfluoride of an element selected from the group consisting of Ti, Zr, Hf, Sn, Ge, B and combinations thereof, and an acid and/or salt that contains phosphorus in water; providing a cathode in contact with the anodizing solution; placing the metallic surface comprised of titanium, titanium alloy, aluminum or aluminum alloy as an anode in the anodizing solution; and passing a direct current or an alternating current between the anode and the cathode for a time effective to form a protective coating on the metallic surface of the article. In a preferred embodiment, at least one compound which is an oxide, hydroxide, carbonate or alkoxide of at least one element selected from the group consisting of Ti, Zr, Si, Hf, Sn, B, Al and Ge is additionally used to prepare the anodizing solution.

It is also an object of the invention to provide an anodizing solution having a pH of 2-6. The anodizing solution pH is preferably adjusted using ammonia, an amine, an alkali metal hydroxide or a mixture thereof.

It is a yet further object of the invention to provide a method of forming a protective coating on a metallic surface of a article, the method comprising providing an anodizing solution, the anodizing solution having been prepared by combining water, a phosphorus containing oxy acid and/or salt, one or more water-soluble complex fluorides of titanium and/or zirconium or salts thereof and an oxide, hydroxide, carbonate or alkoxide of zirconium; providing a cathode in contact with the anodizing solution; placing an article having at least one surface comprised predominantly of aluminum or titanium as an anode in the anodizing solution; and passing a direct current or an alternating current between the anode and the cathode for a time effective to form a protective coating on the at least one surface of the article. In a preferred embodiment, the water-soluble complex fluoride is a complex fluoride of titanium and the current is direct current. In one aspect of the invention, one or more of $H_2TiF_6$, salts of $H_2TiF_6$, $H_2ZrF_6$, and salts of $H_2ZrF_6$, s used to prepare the anodizing solution. In another aspect of the invention, zirconium basic carbonate is used to prepare the anodizing solution.

It is another object of the invention to provide an article of manufacture comprising: a substrate having at least one surface comprising sufficient aluminum and/or titanium to act as an anode at peak voltages of at least 300 volts, preferably at least 400, most preferably at least 500 volts; an alkali, acid and corrosion resistant, adherent protective layer comprising at least one oxide selected from the group consisting of Ti, Zr, Hf, Ge B and mixtures thereof bonded to the at least one surface, having been anodically deposited on the surface so as to be chemically bonded thereto; the protective layer, further comprising phosphorus, in amounts of, in increasing order of preference, less than 10, 5, 2.5, 1 wt %. In preferred embodiments, the adherent protective layer is predominantly comprised of titanium dioxide, zirconium oxide or a mixture thereof.

It is a further object of the invention to provide an article further comprising a layer of paint deposited on the adherent protective layer. The paint may comprise a clear coat. In a preferred embodiment, the article of manufacture is comprised predominantly of titanium or aluminum. In a particularly preferred embodiment, the article is an automobile wheel comprised predominantly of aluminum. Alternatively, the article may be a composite structure having a first portion comprised predominantly of aluminum and a second portion comprised predominantly of titanium.

DETAILED DESCRIPTION OF THE INVENTION

Figure 1:
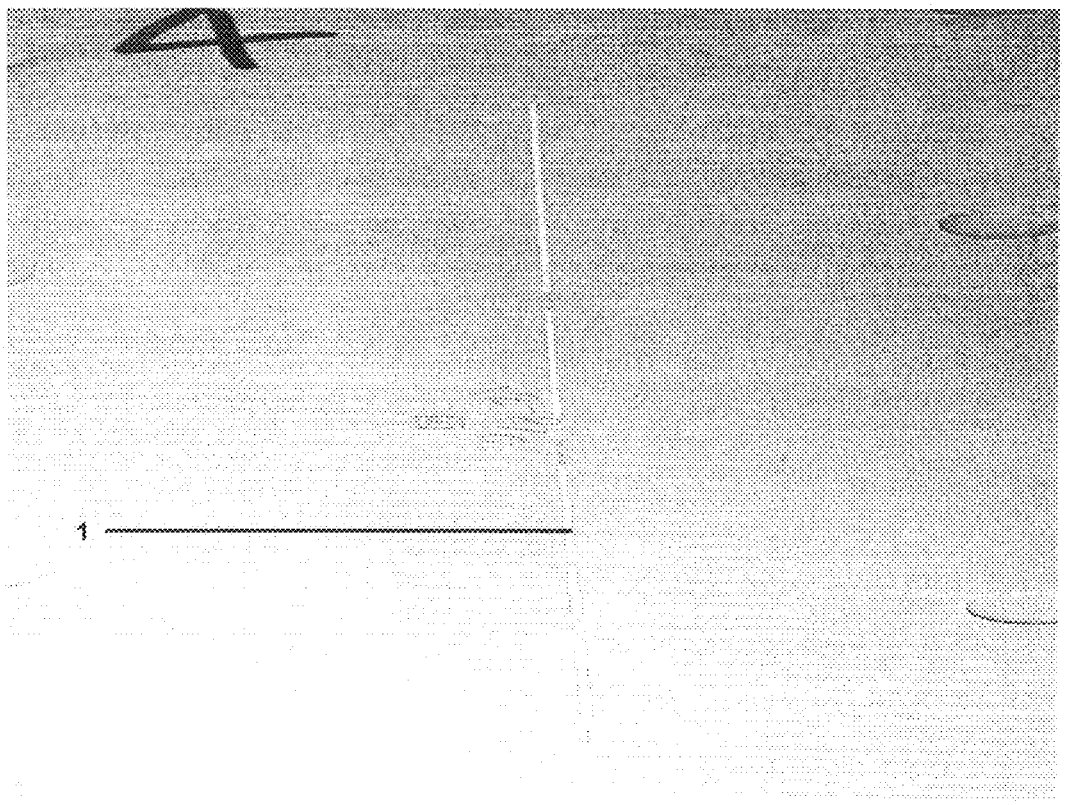
FIG. 1 is a photograph of a portion of a test panel of a 400 Series aluminum alloy that has been anodically coated with a 9-10 micron thick layer of ceramic predominantly comprising titanium and oxygen. The test panel shows a vertical line scribed into the coating. There is no corrosion extending from the scribed line.

Except in the claims and the operating examples, or where otherwise expressly indicated, all numerical quantities in this description indicating amounts of material or conditions of reaction and/or use are to be understood as modified by the word "about" in describing the scope of the invention. Practice within the numerical limits stated is generally preferred, however. Also, throughout the description, unless expressly stated to the contrary: percent, "parts of", and ratio values are by weight or mass; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) between one or more newly added constituents and one or more constituents already present in the composition when the other constituents are added; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise, such counterions may be freely selected, except for avoiding counterions that act adversely to an object of the invention; the term "paint" and its grammatical variations includes any more specialized types of protective exterior coatings that are also known as, for example, lacquer, electropaint, shellac, porcelain enamel, top coat, base coat, color coat, and the like; the word "mole" means "gram mole", and the word itself and all of its grammatical variations may be used for any chemical species defined by all of the types and numbers of atoms present in it, irrespective of whether the species is ionic, neutral, unstable, hypothetical or in fact a stable neutral substance with well defined molecules; and the terms "solution", "soluble", "homogeneous", and the like are to be understood as including not only true equilibrium solutions or homogeneity but also dispersions.

There is no specific limitation on the aluminum, titanium, aluminum alloy or titanium alloy article to be subjected to anodization in accordance with the present invention. It is desirable that at least a portion of the article is fabricated from a metal that contains not less than 50% by weight, more preferably not less than 70% by weight titanium or aluminum. Preferably, the article is fabricated from a metal that contains not less than, in increasing order of preference, 30, 40, 50, 60, 70, 80, 90, 95, 100% by weight titanium or aluminum.

In carrying out the anodization of a workpiece, an anodizing solution is employed which is preferably maintained at a temperature between 0° C. and 90° C. It is desirable that the temperature be at least, in increasing order of preference 5, 10, 15, 20, 25, 30, 40, 50° C. and not more than 90, 88, 86, 84, 82, 80, 75, 70, 65° C.

The anodization process comprises immersing at least a portion of the workpiece in the anodizing solution, which is preferably contained within a bath, tank or other such container. The article (workpiece) functions as the anode. A second metal article that is cathodic relative to the workpiece is also placed in the anodizing solution. Alternatively, the anodizing solution is placed in a container which is itself cathodic relative to the workpiece (anode). When using pulsed current, an average voltage potential not in excess of in increasing order of preference 250 volts, 200 volts, 175 volts, 150 volts, 125 volts is then applied across the electrodes until a coating of the desired thickness is formed on the surface of the aluminum article in contact with the anodizing solution. When certain anodizing solution compositions are used, good results may be obtained even at average voltages not in excess of 100 volts. It has been observed that the formation of a corrosion- and abrasion-resistant protective coating is often associated with anodization conditions which are effective to cause a visible light-emitting discharge (sometimes referred to herein as a "plasma", although the use of this term is not meant to imply that a true plasma exists) to be generated (either on a continuous or intermittent or periodic basis) on the surface of the aluminum article.

In one embodiment, direct current (DC) is used at 10-400 Amps/square foot and 200 to 600 volts. In another embodiment, the current is pulsed or pulsing current. Non-pulsed direct current is desirably used in the range of 200-600 volts; preferably the voltage is at least, in increasing order of preference 200, 250, 300, 350, 400 and at least for the sake of economy, not more than in increasing order of preference 700, 650, 600, 550. Direct current is preferably used, although alternating current may also be utilized (under some conditions, however, the rate of coating formation may be lower using AC). The frequency of the wave may range from 10 to 10,000 Hertz; higher frequencies may be used. The "off" time between each consecutive voltage pulse preferably lasts between 10% as long as the voltage pulse and 1000% as long as the voltage pulse. During the "off" period, the voltage need not be dropped to zero (i.e., the voltage may be cycled between a relatively low baseline voltage and a relatively high ceiling voltage). The baseline voltage thus may be adjusted to a voltage that is from 0% to 99.9% of the peak applied ceiling voltage. Low baseline voltages (e.g., less than 30% of the peak ceiling voltage) tend to favor the generation of a periodic or intermittent visible light-emitting discharge, while higher baseline voltages (e.g., more than 60% of the peak ceiling voltage) tend to result in continuous plasma anodization (relative to the human eye frame refresh rate of 0.1-0.2 seconds). The current can be pulsed with either electronic or mechanical switches activated by a frequency generator. The average amperage per square foot is at least in increasing order of preference 10, 20, 30, 40, 50, 60, 70, 80, 90, 100, 105, 110, 115, and not more than at least for economic considerations in increasing order of preference 300, 275, 250, 225, 200, 180, 170, 160, 150, 140, 130, 125. More complex waveforms may also be employed, such as, for example, a DC signal having an AC component. Alternating current may also be used, with voltages desirably between 200 and 600 volts. The higher the concentration of the electrolyte in the anodizing solution, the lower the voltage can be while still depositing satisfactory coatings.

A number of different types of anodizing solutions may be successfully used in the process of this invention, as will be described in more detail hereinafter. However, it is believed that a wide variety of water-soluble or water-dispersible anionic species containing metal, metalloid, and/or non-metal elements are suitable for use as components of the anodizing solution. Representative elements include, for example, phosphorus, titanium, zirconium, hafnium, tin, germanium, boron, vanadium, fluoride, zinc, niobium, molybdenum, manganese, tungsten and the like (including combinations of such elements). In a preferred embodiment of the invention, the components of the anodizing solution are titanium and/or zirconium.

Without wishing to be bound by theory, it is thought that the anodization of aluminum, titanium, aluminum alloy and titanium alloy articles in the presence of complex fluoride or oxyfluoride species to be described subsequently in more detail leads to the formation of surface films comprised of metal/metalloid oxide ceramics (including partially hydrolyzed glasses containing O, OH and/or F ligands) or metal/non-metal compounds wherein the metal comprising the surface film includes metals from the complex fluoride or oxyfluoride species and some metals from the article. The plasma or sparking which often occurs during anodization in accordance with the present invention is believed to destabilize the anionic species, causing certain ligands or substituents on such species to be hydrolyzed or displaced by O and/or OH or metal-organic bonds to be replaced by metal-O or metal-OH bonds. Such hydrolysis and displacement reactions render the species less water-soluble or water-dispersible, thereby driving the formation of the surface coating of oxide that forms the second protective coating.

A pH adjuster may be present in the anodizing solution; suitable pH adjusters include, by way of nonlimiting example, ammonia, amine or other base. The amount of pH adjuster is limited to the amount required to achieve a pH of 1-6.5, preferably 2-6, most preferably 3-5, and is dependent upon the type of electrolyte used in the anodizing bath. In a preferred embodiment, the amount of pH adjuster is less than 1% w/v.

In certain embodiments of the invention, the anodizing solution is essentially (more preferably, entirely) free of chromium, permanganate, borate, sulfate, free fluoride and/or free chloride.

The anodizing solution used preferably comprises water and at least one complex fluoride or oxyfluoride of an element selected from the group consisting of Ti, Zr, Hf, Sn, Al, Ge and B (preferably, Ti and/or Zr). The complex fluoride or oxyfluoride should be water-soluble or water-dispersible and preferably comprises an anion comprising at least 1 fluorine atom and at least one atom of an element selected from the group consisting of Ti, Zr, Hf, Sn, Al, Ge or B. The complex fluorides and oxyfluorides (sometimes referred to by workers in the field as "fluorometallates") preferably are substances with molecules having the following general empirical formula (I):

$$H_pT_qF_rO_s \quad (I)$$

wherein: each of p, q, r, and s represents a non-negative integer; T represents a chemical atomic symbol selected from the group consisting of Ti, Zr, Hf, Sn, Al, Ge, and B; r is at least 1; q is at least 1; and, unless T represents B, (r+s) is at least 6. One or more of the H atoms may be replaced by suitable cations such as ammonium, metal, alkaline earth metal or alkali metal cations (e.g., the complex fluoride may be in the form of a salt, provided such salt is water-soluble or water-dispersible).

Illustrative examples of suitable complex fluorides include, but are not limited to, $H_2TiF_6$, $H_2ZrF_6$, $H_2HfF_6$, $H_2GeF_6$, $H_2SnF_6$, $H_3AlF_6$, and $HBF_4$ and salts (fully as well as partially neutralized) and mixtures thereof. Examples of suitable complex fluoride salts include $SrZrF_6$, $MgZrF_6$, $Na_2ZrF_6$, and $Li_2ZrF_6$, $SrTiF_6$, $MgTiF_6$, $Na_2TiF_6$, and $Li_2TiF_6$.

The total concentration of complex fluoride and complex oxyfluoride in the anodizing solution preferably is at least 0.005 M. Generally, there is no preferred upper concentration limit, except of course for any solubility constraints. It is desirable that the total concentration of complex fluoride and complex oxyfluoride in the anodizing solution be at least 0.005, 0.010, 0.020, 0.030, 0.040, 0.050, 0.060, 0.070, 0.080, 0.090, 0.10, 0.20, 0.30, 0.40, 0.50, 0.60 M, and if only for the sake of economy be not more than, in increasing order of preference 2.0, 1.5, 1.0, 0.80 M.

To improve the solubility of the complex fluoride or oxyfluoride, especially at higher pH, it may be desirable to include an inorganic acid (or salt thereof) that contains fluorine but does not contain any of the elements Ti, Zr, Hf, Sn, Al, Ge or B in the electrolyte composition. Hydrofluoric acid or a salt of hydrofluoric acid such as ammonium bifluoride is preferably used as the inorganic acid. The inorganic acid is believed to prevent or hinder premature polymerization or condensation of the complex fluoride or oxyfluoride, which otherwise (particularly in the case of complex fluorides having an atomic ratio of fluorine to T of 6) may be susceptible to slow spontaneous decomposition to form a water-insoluble oxide. Certain commercial sources of hexafluorotitanic acid and hexafluorozirconic acid are supplied with an inorganic acid or salt thereof, but it may be desirable in certain embodiments of the invention to add still more inorganic acid or inorganic salt.

A chelating agent, especially a chelating agent containing two or more carboxylic acid groups per molecule such as nitrilotriacetic acid, ethylene diamine tetraacetic acid, N-hydroxyethyl-ethylenediamine triacetic acid, or diethylene-triamine pentaacetic acid or salts thereof, may also be included in the anodizing solution. Other Group IV compounds may be used, such as, by way of non-limiting example, Ti and/or Zr oxalates and/or acetates, as well as other stabilizing ligands, such as acetylacetonate, known in the art that do not interfere with the anodic deposition of the anodizing solution and normal bath lifespan. In particular, it is necessary to avoid organic materials that either decompose or undesirably polymerize in the energized anodizing solution.

Rapid coating formation is generally observed at average voltages of 150 volts or less (preferably 100 or less), using pulsed DC. It is desirable that the average voltage be of sufficient magnitude to generate coatings of the invention at a rate of at least 1 micron thickness per minute, preferably at least 3-8 microns in 3 minutes. If only for the sake of economy, it is desirable that the average voltage be less than, in increasing order of preference, 150, 140, 130, 125, 120, 115, 110, 100, 90 volts. The time required to deposit a coating of a selected thickness is inversely proportional to the concentration of the anodizing bath and the amount of current Amps/square foot used. By way of non-limiting example, parts may be coated with an 8 micron thick metal oxide layer in as little as 10-15 seconds at concentrations cited in the Examples by increasing the Amps/square foot to 300-2000 amps/square foot. The determination of correct concentrations and current amounts for optimum part coating in a given period of time can be made by one of skill in the art based on the teachings herein with minimal experimentation.

Coatings of the invention are typically fine-grained and desirably are at least 1 micron thick, preferred embodiments have coating thicknesses from 1-20 microns. Thinner or thicker coatings may be applied, although thinner coatings may not provide the desired coverage of the article. Without being bound by a single theory, it is believed that, particularly for insulating oxide films, as the coating thickness increases the film deposition rate is eventually reduced to a rate that approaches zero asymptotically. Add-on mass of coatings of the invention ranges from approximately 5-200 g/m$^2$ or more and is a function of the coating thickness and the composition of the coating. It is desirable that the add-on mass of coatings be at least, in increasing order of preference, 5, 10, 11, 12, 14, 16, 18, 20, 25, 30, 35, 40, 45, 50 g/m$^2$.

In a preferred embodiment of the invention, the anodizing solution used comprises water, a water-soluble and/or water-dispersible phosphorus oxy acid or salt, for instance an acid or salt containing phosphate anion; and at least one of $H_2TiF_6$ and $H_2ZrF_6$. Preferably, the pH of the anodizing solution is neutral to acid (more preferably, 6.5 to 2).

It was surprisingly found that the combination of a phosphorus containing acid and/or salt and the complex fluoride in the anodizing solution produced a different type of anodically deposited coating. The oxide coatings deposited comprised predominantly oxides of anions present in the anodizing solution prior to any dissolution of the anode. That is, this process results in coatings that result predominantly from deposition of substances that are not drawn from the body of the anode, resulting in less change to the substrate of the article being anodized as compared to substrates anodized according to the prior art where metals for the coatings come predominantly from metal of the substrate.

In this embodiment, it is desirable that the anodizing solution comprise the at least one complex fluoride, e.g. $H_2TiF_6$ and/or $H_2ZrF_6$ in an amount of at least, in increasing order of preference 0.2, 0.4, 0.6, 0.8. 1.0, 1.2, 1.3, 1.4, 1.5, 2.0, 2.5, 3.0, 3.5 wt. % and not more than, in increasing order of preference 10, 9.5, 9.0, 8.5, 8.0, 7.5, 7.0, 6.5, 6.0, 5.5, 5.0, 4.5. 4.0 wt. %. The at least one complex fluoride may be supplied from any suitable source such as, for example, various aqueous solutions known in the art. For $H_2TiF_6$ commercially available solutions typically range in concentration from 50-60 wt %; while for $H_2ZrF_6$ such solutions range in concentration between 20-50%.

The phosphorus oxysalt may be supplied from any suitable source such as, for example, ortho-phosphoric acid, pyrophosphoric acid, tri-phosphoric acid, meta-phosphoric acid, polyphosphoric acid and other combined forms of phosphoric acid, as well as phosphorous acids and hypo-phosphorous acids, and may be present in the anodizing solution in partially or fully neutralized form (e.g., as a salt, wherein the counter ion(s) are alkali metal cations, ammonium or other such species that render the phosphorus oxysalt water-soluble). Organophosphates such as phosphonates and the like may also be used (for example, various phosphonates are available from Rhodia Inc. and Solutia Inc.) provided that the organic component does not interfere with the anodic deposition.

Particularly preferred is the use of a phosphorus oxysalt in acid form. The phosphorus concentration in the anodizing solution is at least 0.01 M. It is preferred that the concentration of phosphorus in the anodizing solution be at least, in increasing order of preference, 0.01M, 0.015, 0.02, 0.03, 0.04, 0.05, 0.07, 0.09, 0.10, 0.12, 0.14, 0.16. In embodiments where the pH of the anodizing solution is acidic (pH<7), the phosphorus concentration can be 0.2 M, 0.3 M or more and preferably, at least for economy is not more than 1.0, 0.9, 0.8, 0.7, 0.6 M. In embodiments where the pH is neutral to basic, the concentration of phosphorus in the anodizing solution is not more than, in increasing order of preference 0.40, 0.30, 0.25, 0.20 M.

A preferred anodizing solution for use in forming a protective ceramic coating according to this embodiment on an aluminum or titanium containing substrate may be prepared using the following components:

| | |
|---|---|
| $H_2TiF_6$ | 0.05 to 10 wt. % |
| $H_3PO_4$ | 0.1 to 0.6 wt. % |
| Water | Balance to 100% |

The pH is adjusted to the range of 2 to 6 using ammonia, amine or other base.

With the aforedescribed anodizing solutions, the generation of a sustained "plasma" (visible light emitting discharge) during anodization is generally attained using pulsed DC having an average voltage of no more than 150 volts. In the most preferred operation, the average pulse voltage is 100-200 volts. Non-pulsed direct current, so called "straight DC", or alternating current may also be used with average voltages of 300-600 volts.

The anodized coatings produced in accordance with the invention typically range in color from blue-grey and light grey to charcoal grey depending upon the coating thickness and relative amounts of Ti and Zr in the coatings. The coatings exhibit high hiding power at coating thicknesses of 2-10 microns, and excellent corrosion resistance. FIG. 1 shows a photograph of a portion of a test panel of a 400 series aluminum alloy that has been anodically coated according to a process of the invention resulting in an 8-micron thick layer of ceramic predominantly comprising titanium dioxide. The coated test panel (4) was a light grey in color, but provided good hiding power. The coated test panel had a scribed vertical line (1) that was scratched into the coating down to bare metal prior to salt fog testing. Despite being subjected to 1000 hours of salt fog testing according to ASTM B-117-03, there was no corrosion extending from the scribed line.

Figure 2:
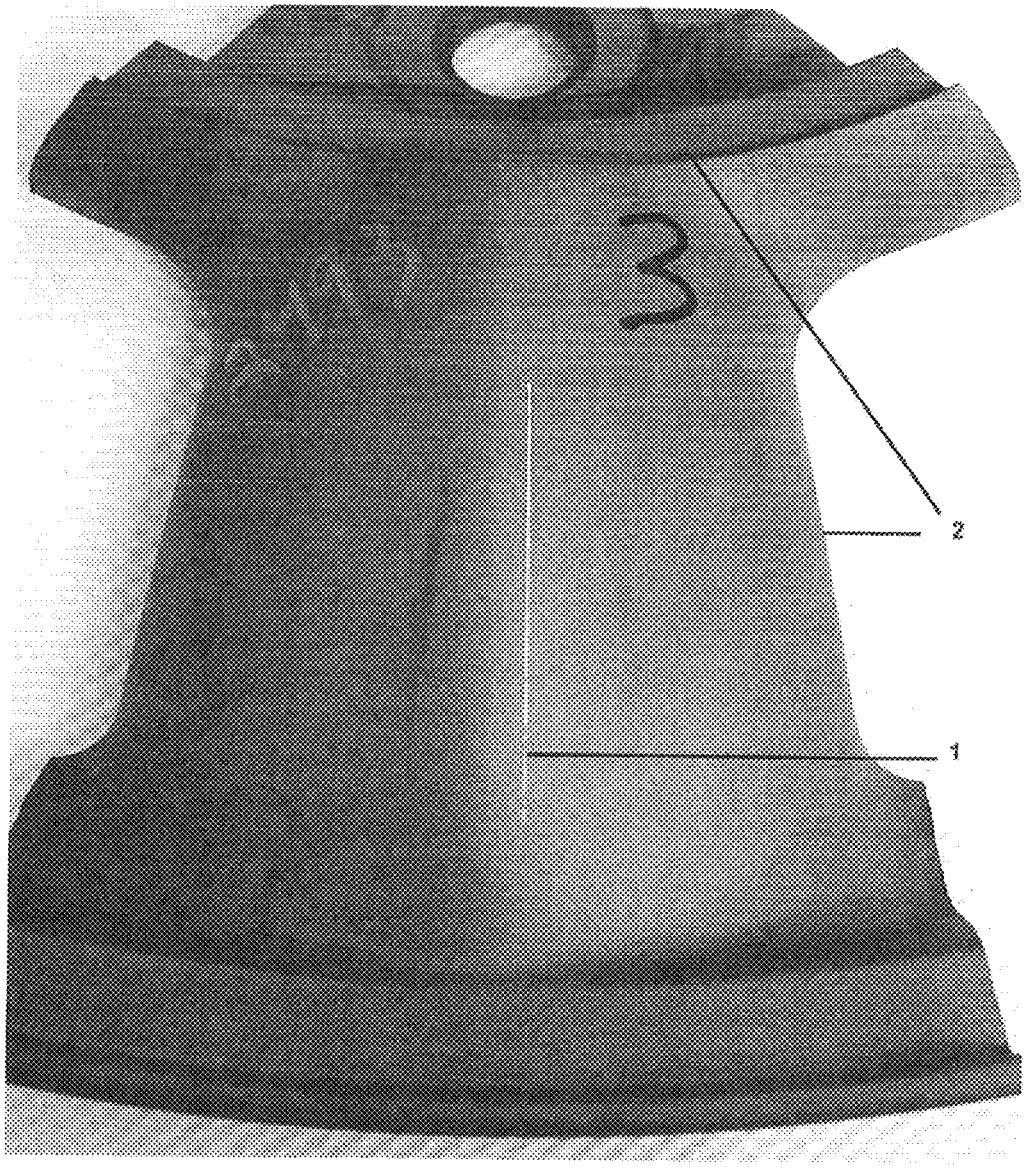
FIG. 2 is a photograph of a coated test specimen. The test specimen is a wedge shaped section of a commercially available aluminum wheel. The test specimen has been anodically coated according to a process of the invention. The coating completely covered the surfaces of the test specimen including the design edges. The test specimen had a vertical line scribed into the coating. There was no corrosion extending from the scribed line and no corrosion at the design edges.

FIG. 2 is a photograph of a portion of a commercially available bare aluminum wheel. The aluminum wheel was cut into pieces and the test specimen was anodically coated according to a process of the invention resulting in a 10-micron thick layer of ceramic predominantly comprising titanium dioxide. Without being bound to a single theory, the darker grey coating is attributed to the greater thickness of the coating. The coating completely covered the surfaces of the aluminum wheel including the design edges. The coated aluminum wheel portion (3) showed a scribed vertical line (1) scratched into the coating down to bare metal prior to salt fog testing. Despite being subjected to 1000 hours of salt fog according to ASTM B-117-03, there was no corrosion extending from the scribed line and no corrosion at the design edges (2). References to "design edges" will be understood to include the cut edges as well as shoulders or indentations in the article which have or create external corners at the intersection of lines generated by the intersection of two planes. The excellent protection of the design edges (2) is an improvement over conversion coatings, including chrome containing conversion coatings, which show corrosion at the design edges after similar testing.

Figure 3:
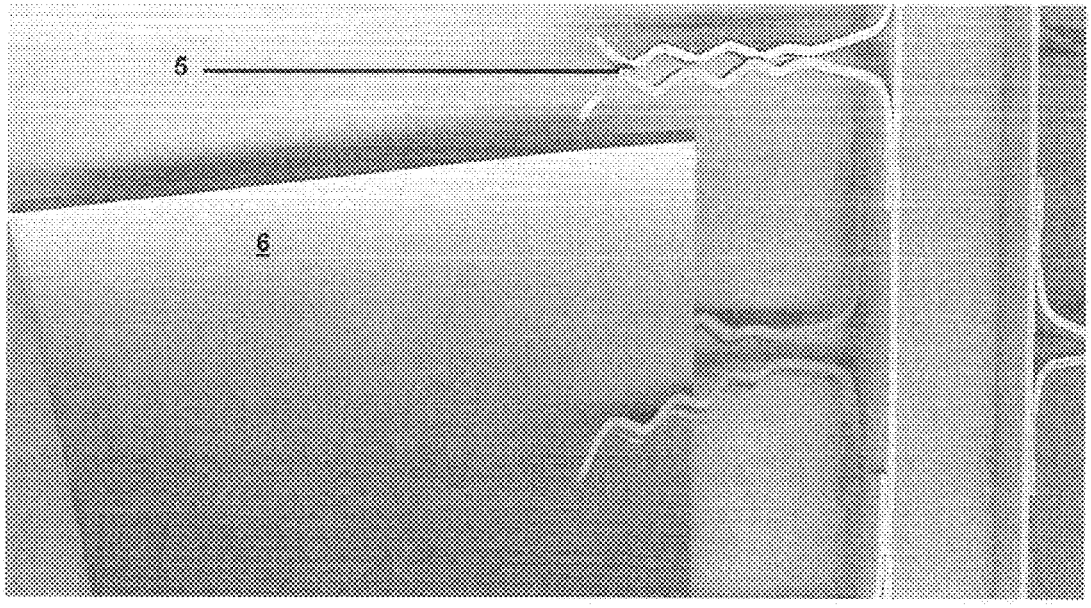
FIG. 3 shows a photograph a titanium clamp (5) and a portion of an aluminum-containing test panel (6) coated according to the invention.

FIG. 3 shows a photograph of two coated substrates: a titanium clamp (5) and a portion of an aluminum-containing test panel (6). The clamp and the panel, were coated simultaneously, in the same anodizing bath for the same time period according to the process of the invention. Although the substrates do not have the same composition, the coating on the surface appeared uniform and monochromatic. The substrates were anodically coated according to the invention resulting in a 7-micron thick layer of ceramic predominantly comprising titanium dioxide. The coating was a light grey in color, and provided good hiding power.

Before being subjected to anodic treatment in accordance with the invention, the aluminiferous metal article preferably is subjected to a cleaning and/or degreasing step. For example, the article may be chemically degreased by exposure to an alkaline cleaner such as, for example, a diluted solution of PARCO Cleaner 305 (a product of the Henkel Surface Technologies division of Henkel Corporation, Madison Heights, Mich.). After cleaning, the article preferably is rinsed with water. Cleaning may then, if desired, be followed by etching with an acidic deoxidixer/desmutter such as SC592, commercially available from Henkel Corporation, or other deoxidizing solution, followed by additional rinsing prior to anodization. Such pre-anodization treatments are well known in the art.

The invention will now be further described with reference to a number of specific examples, which are to be regarded solely as illustrative and not as restricting the scope of the invention.

EXAMPLES

Example 1

An aluminum alloy substrate in the shape of a cookware pan was the test article for Example 1. The article was cleaned in a diluted solution of PARCO Cleaner 305, an alkaline cleaner and an alkaline etch cleaner, such as Aluminum Etchant 34, both commercially available from Henkel Corporation. The aluminum alloy article was then desmutted in SC592, an iron based acidic deoxidizer commercially available from Henkel Corporation.

The aluminum alloy article was then coated, using an anodizing solution prepared using the following components:

| | |
|---|---|
| $H_2TiF_6$ | 12.0 g/L |
| $H_3PO_4$ | 3.0 g/L |

The pH was adjusted to 2.1 using ammonia. The aluminum-containing article was subjected to anodization for 6 minutes in the anodizing solution using pulsed direct current having a peak ceiling voltage of 500 volts (approximate average voltage=135 volts). The "on" time was 10 milliseconds, the "off" time was 30 milliseconds (with the "off" or baseline voltage being 0% of the peak ceiling voltage). A uniform blue-grey coating 11 microns in thickness was formed on the surface of the aluminum-containing article. The coated article was analyzed using energy dispersive spectroscopy and found to have a coating predominantly of titanium and oxygen. Traces of phosphorus, estimated at less than 10 wt %, were also seen in the coating.

Example 2

A test panel of 400 series aluminum alloy was treated according to the procedure of Example 1. A scribe line was scratched in the test panel down to bare metal and subjected to the following testing: 1000 hours of salt fog according to ASTM B-117-03. The test panel showed no signs of corrosion along the scribe line, see FIG. 1.

Example 3

A section of an aluminum alloy wheel, having no protective coating, was the test article for Example 3. The test article was treated as in Example 1, except that the anodizing treatment was as follows:

The aluminum alloy article was coated, using an anodizing solution prepared using the following components:

| | |
|---|---|
| $H_2TiF_6$ (60%) | 20.0 g/L |
| $H_3PO_4$ | 4.0 g/L |

The pH was adjusted to 2.2 using aqueous ammonia. The article was subjected to anodization for 3 minutes in the anodizing solution using pulsed direct current having a peak ceiling voltage of 450 volts (approximate average voltage=130 volts) at 90° F. The "on" time was 10 milliseconds, the "off" time was 30 milliseconds (with the "off" or baseline voltage being 0% of the peak ceiling voltage). The average current density was 40 amps/ft2. A uniform coating, 8 microns in thickness, was formed on the surface of the aluminum alloy article. The article was analyzed using qualitative energy dispersive spectroscopy and found to have a coating predominantly of titanium and oxygen. Traces of phosphorus were also seen in the coating.

A scribe line was scratched in the coated article down to bare metal and the article subjected to the following testing: 1000 hours of salt fog per ASTM B-117-03. The coated test article showed no signs of corrosion along the scribe line or along the design edges, see FIG. 2.

Example 4

An aluminum alloy test panel was treated as in Example 1. The test panel was submerged in the anodizing solution using a titanium alloy clamp, which was also submerged. A uniform blue-grey coating, 7 microns in thickness, was formed on the surface of the predominantly aluminum test panel. A similar blue-grey coating, 7 microns in thickness, was formed on the surface of the predominantly titanium clamp. Both the test panel and the clamp were analyzed using qualitative energy dispersive spectroscopy and found to have a coating predominantly of titanium and oxygen, with a trace of phosphorus.

Example 5

Aluminum alloy test panels of 6063 aluminum were treated according to the procedure of Example 1, except that the anodizing treatment was as follows:

The aluminum alloy articles were coated, using an anodizing solution containing phosphorous acid in place of phosphoric acid:

| | |
|---|---|
| $H_2TiF_6$ (60%) | 20.0 g/L |
| $H_3PO_3$ (70%) | 8.0 g/L |

The aluminum alloy articles were subjected to anodization for 2 minutes in the anodizing solution. Panel A was subjected to 300 to 500 volts applied voltage as direct current. Panel B was subjected to the same peak voltage but as pulsed direct current. A uniform grey coating 5 microns in thickness was formed on the surface of both Panel A and Panel B.

Although the invention has been described with particular reference to specific examples, it is understood that modifications are contemplated. Variations and additional embodiments of the invention described herein will be apparent to those skilled in the art without departing from the scope of the invention as defined in the claims to follow. The scope of the invention is limited only by the breadth of the appended claims.

What is claimed is:

1. An article having at least one metal surface comprised of aluminum or aluminum alloy and a ceramic oxide protective coating deposited on said metal surface according to a method comprising:

A) providing an anodizing solution comprised of water, a phosphorus containing acid and/or salt, and one or more additional components selected from the group consisting of:
   a) water-soluble complex fluorides,
   b) water-soluble complex oxyfluorides,
   c) water-dispersible complex fluorides, and
   d) water-dispersible complex oxyfluorides of elements selected from the group consisting of Ti, Zr, Hf, Ge, B and mixtures thereof;

B) providing a cathode in contact with said anodizing solution;

C) placing an article having at least one metal surface comprised of aluminum or aluminum alloy as an anode in said anodizing solution; and D) passing at least one current selected from:
   a. a pulsed direct current having a peak voltage of 200 to 600 volts; and
   b. a non-pulsed direct current or an alternating current at voltage from 200 to 600 volts;

between the anode and cathode through said anodizing solution for a time effective to form a ceramic oxide protective coating, containing phosphorus, on the at least one metal surface of the article; wherein said ceramic oxide protective coating is comprised predominantly of oxides of elements selected from the group consisting of Ti, Zr, Hf, Ge, B and mixtures thereof.

2. The article of claim 1 wherein the protective coating is predominantly comprised of titanium dioxide or zirconium oxide.

3. The article of claim 1 wherein the metal surface comprises predominantly aluminum and the protective coating is predominantly oxides of elements selected from the group consisting of Ti, Zr, Hf, Ge, B and mixtures thereof.

4. The article of claim 1 wherein said at least one current is said pulsed direct current.

5. The article of claim 1 wherein said at least one current is pulsed direct current having a peak voltage of 300-600 volts between the anode and cathode.

6. The article of claim 1 wherein said at least one current is said non-pulsed direct current or an alternating current at voltage from 200 to 600 volts.

7. The article of claim 1 wherein the one or more water-soluble and/or water-dispersible complex fluorides comprise Ti and/or Zr.

8. The article of claim 1 wherein the anodizing solution has a pH of 1-6.

9. The article of claim 1 wherein said phosphorus containing acid and/or salt is present in a concentration, measured as P, of 0.01 to 0.25 M.

10. The article of claim 1 wherein the anodizing solution is additionally comprised of one or more additional components selected from the group consisting of:

a) water-soluble and/or water-dispersible zirconium oxysalts;
b) water-soluble and/or water-dispersible vanadium oxysalts;
c) water-soluble and/or water-dispersible titanium oxysalts;
d) water-soluble and/or water-dispersible niobium salts;
e) water-soluble and/or water-dispersible molybdenum salts;

f) water-soluble and/or water-dispersible manganese salts; and g) water-soluble and/or water-dispersible tungsten salts.

11. The article of claim 1 wherein the anodizing solution additionally comprises at least one of:

a) water-soluble and/or water-dispersible alkali metal fluorides and/or hydroxides;

b) a pH adjuster selected from ammonia, an amine, an alkali metal hydroxide or a mixture thereof;

c) HF or a salt thereof;

d) a chelating agent;

e) an oxide, hydroxide, carbonate or alkoxide of at least one element selected from the group consisting of Ti, Zr, Si, Hf, B, Al and Ge.

12. An article having a metal surface comprised predominantly of aluminum and an oxide coating comprised of predominantly of titanium dioxide or zirconium oxide deposited on said metal surface according to a method comprising:

A) providing an anodizing solution comprised of water, a phosphorus containing acid and/or salt, and one or more additional components selected from the group consisting of:

a) water-soluble complex fluorides, b) water-soluble complex oxyfluorides, c) water-dispersible complex fluorides, and d) water-dispersible complex oxyfluorides of elements selected from the group consisting of Ti, Zr, Hf, Sn, Al, Ge and B and mixtures thereof;

B) providing a cathode in contact with said anodizing solution;

C) placing an article having at least one metal surface comprised of aluminum or aluminum alloy as an anode in said anodizing solution; and D) passing at least one current between the anode and cathode through said anodizing solution for a time effective to form a protective coating on said at least one metal surface;

wherein the at least one metal surface comprises predominantly aluminum and the protective coating has an add-on mass from approximately 5 $g/m^2$ to approximately 200 $g/m^2$ and is predominantly titanium dioxide or zirconium oxide.

13. The article of claim 12 wherein said at least one current comprises pulsed direct current.

14. The article of claim 12 wherein said at least one current comprises pulsed direct current which has an average voltage of not more than 200 volts.

15. The article of claim 12 wherein said at least one current comprises pulsed direct current having a peak voltage of 300-600 volts between the anode and cathode.

16. The article of claim 12 wherein said at least one current comprises non-pulsed direct current or an alternating current at voltage from 200 to 600 volts.

17. The article of claim 12 wherein said phosphorus containing acid and/or salt is present in a concentration, measured as P, of 0.01 to 0.25 M.

18. The article of claim 12 wherein the anodizing solution is additionally comprised of one or more additional components selected from the group consisting of:

a) water-soluble and/or water-dispersible zirconium oxysalts;

b) water-soluble and/or water-dispersible vanadium oxysalts;

c) water-soluble and/or water-dispersible titanium oxysalts;

d) water-soluble and/or water-dispersible niobium salts;

e) water-soluble and/or water-dispersible molybdenum salts;

f) water-soluble and/or water-dispersible manganese salts; and g) water-soluble and/or water-dispersible tungsten salts.

19. The article of claim 12 wherein the anodizing solution additionally comprises at least one of:

a) water-soluble and/or water-dispersible alkali metal fluorides and/or hydroxides;

b) a pH adjuster selected from ammonia, an amine, an alkali metal hydroxide or a mixture thereof;

c) HF or a salt thereof;

d) a chelating agent;

e) an oxide, hydroxide, carbonate or alkoxide of at least one element selected from the group consisting of Ti, Zr, Si, Hf, Sn, B, Al and Ge.

20. An article of manufacture comprising:

a) a substrate having at least one surface comprising aluminum, aluminum alloy, titanium or titanium alloy;

b) an adherent protective layer comprised predominantly of at least one oxide of elements selected from the group consisting of Ti, Zr, Hf, Al, Ge, B and mixtures thereof, deposited on the at least one surface;

wherein the adherent protective layer deposited has an add-on mass from approximately 5 $g/m^2$ to approximately 200 $g/m^2$ resulting predominantly from deposition of oxides of elements that are not drawn from the substrate.

21. The article of claim 20 wherein the article shows no corrosion after being subjected to 1000 hours of salt fog testing according to ASTM B-117-03.

22. The article of claim 20 wherein the adherent protective layer is comprised of titanium dioxide and/or zirconium oxide.

23. The article of claim 22 wherein the at least one surface is predominantly aluminum or aluminum alloy.

24. The article of claim 20 wherein the adherent protective layer is predominantly comprised of titanium dioxide or zirconium dioxide.

25. The article of claim 20 further comprising at least one additional layer on the adherent protective layer.

26. The article of claim 20 wherein the article of manufacture is an automobile part comprised predominantly of aluminum.

27. The article of claim 20 further comprising at least one layer of paint deposited on the adherent protective layer.

28. An article of manufacture comprising:

a) a substrate having at least one surface comprising aluminum, aluminum alloy, titanium or titanium alloy;

b) an adherent protective layer comprised predominantly of at least one oxide of elements selected from the group consisting of Ti, Zr, Hf, Al, Ge, B and mixtures thereof, deposited on the at least one surface;

wherein the adherent protective layer deposited has an add-on mass from approximately 5 $g/m^2$to approximately 200 $g/m^2$ resulting predominantly from deposition of oxides of elements that are not drawn from the substrate, wherein the article of manufacture is comprised predominantly of titanium or titanium alloy.

29. An article of manufacture comprising:

a) a substrate having at least one surface comprising aluminum, aluminum alloy, titanium or titanium alloy;

b) an adherent protective layer comprised predominantly of at least one oxide of elements selected from the group consisting of Ti, Zr, Hf, Al, Ge, B and mixtures thereof, deposited on the at least one surface;

wherein the adherent protective layer deposited has an add-on mass from approximately 5 $g/m^2$ to approximately 200 $g/m^2$ resulting predominantly from deposition of oxides of elements that are not drawn from the substrate, wherein the adherent protective layer further comprises at least one co-deposited element selected from the group consisting of vanadium, niobium, molybdenum, manganese, and tungsten.

30. An article of manufacture comprising:

a) a substrate having at least one surface comprising sufficient aluminum such that said surface acts as an anode at peak voltages of at least 300 volts;

b) an adherent protective layer 1 to 20 microns thick, predominantly comprising at least one oxide of elements selected from the group consisting of Ti, Zr, Hf, Ge, B and mixtures thereof, chemically bonded to the at least one surface, said adherent protective layer optionally further comprising Al; said protective layer, further comprising phosphorus.

31. The article of claim 30 wherein the adherent protective layer results predominantly from of oxides of elements that are not drawn from the substrate.

32. The article of claim 30 wherein the article shows no corrosion after being subjected to 1000 hours of salt fog testing according to ASTM B-117-03.

33. The article of claim 30 wherein the adherent protective layer is comprised of titanium dioxide and/or zirconium oxide.

34. The article of claim 30 wherein the article of manufacture is an automobile wheel comprised predominantly of aluminum.

35. The article of claim 30 wherein the adherent protective layer is predominantly comprised of titanium dioxide or zirconium oxide.

36. The article of claim 30 further comprising at least one additional layer on the adherent protective layer.

37. The article of claim 30 further comprising at least one layer of paint deposited on the protective layer.

38. An article having at least one metal surface comprised of aluminum, aluminum alloy, titanium or titanium alloy and a protective layer chemically bonded to the at least one surface, said protective layer comprising:

at least one oxide of elements selected from the group consisting of Ti, Zr, Hf, Ge, B and mixtures thereof;

phosphorus and an oxide of Al.

39. An article having at least one metal surface comprised of aluminum or aluminum alloy and a protective layer chemically bonded directly to the at least one surface, said protective layer comprising:

at least one oxide of elements selected from the group consisting of Ti, Zr, Hf, Ge, B and mixtures thereof;

phosphorus and optionally, Al.

* * * * *